US006443248B2

(12) United States Patent
Yong et al.

(10) Patent No.: US 6,443,248 B2
(45) Date of Patent: Sep. 3, 2002

(54) DRILL BIT INSERTS WITH INTERRUPTION IN GRADIENT OF PROPERTIES

(75) Inventors: Zhou Yong; S. J. Huang, both of The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/923,513

(22) Filed: Aug. 7, 2001

Related U.S. Application Data

(63) Continuation of application No. 09/293,190, filed on Apr. 16, 1999, now Pat. No. 6,315,065.

(51) Int. Cl.[7] ..... E21B 10/08
(52) U.S. Cl. ..... 175/428; 175/426; 175/434
(58) Field of Search ..... 475/374, 426, 475/428, 434

(56) References Cited

U.S. PATENT DOCUMENTS

| | | | | |
|---|---|---|---|---|
| 4,525,178 A | | 6/1985 | Hall | 51/309 |
| 4,627,503 A | | 12/1986 | Horton | 175/329 |
| 4,694,918 A | | 9/1987 | Hall | 175/329 |
| 4,811,801 A | | 3/1989 | Salesley et al. | 175/329 |
| 4,995,887 A | | 2/1991 | Barr et al. | 51/295 |
| 5,045,092 A | | 9/1991 | Keshavan | 51/293 |
| 5,061,293 A | | 10/1991 | Barr et al. | 51/293 |
| 5,135,061 A | * | 8/1992 | Newton | 175/428 |
| 5,154,245 A | | 10/1992 | Waldenström et al. | 175/420 |
| 5,370,195 A | | 12/1994 | Keshavan et al. | 175/420 |
| 5,469,927 A | | 11/1995 | Griffin | 175/432 |
| 5,486,137 A | | 1/1996 | Flood et al. | 451/540 |
| 5,669,271 A | | 9/1997 | Griffin et al. | 76/108.2 |
| 5,722,499 A | * | 3/1998 | Nguyen et al. | 175/431 |
| 5,743,346 A | | 4/1998 | Flood et al. | 175/420.2 |
| 6,290,008 B1 | * | 9/2000 | Portwood et al. | 175/426 |
| 6,315,065 B1 | | 11/2001 | Yong et al. | 175/428 |

FOREIGN PATENT DOCUMENTS

| | | | |
|---|---|---|---|
| EP | 0336697 | 11/1989 | 21/10 |

* cited by examiner

*Primary Examiner*—David Bagnell
*Assistant Examiner*—Jennifer Dougherty
(74) *Attorney, Agent, or Firm*—Conley, Rose & Tayon, P.C.

(57) ABSTRACT

A cutter element for use in a drill bit, comprising a substrate and a plurality of layers thereon. The substrate comprises a grip portion and an extending portion. The layers are applied to the extending portion such that at least one of the layers is harder than at least one of the layers above it. The layers can include one or more layers of polycrystalline diamond and can include a layer in which the composition of the material changes with distance from the substrate.

31 Claims, 2 Drawing Sheets

DRILL BIT INSERTS WITH INTERRUPTION IN GRADIENT OF PROPERTIES

RELATED APPLICATIONS

This application is a continuation of U.S. application Ser. No. 09/293,190 filed Apr. 16, 1999 now U.S. Pat. No. 6,315,065.

TECHNICAL FIELD OF THE INVENTION

The present invention relates generally to cutting elements for use in earth-boring drill bits and, more specifically, to a means for increasing the life of cutting elements that comprise one or more layers of ultrahard material, such as diamond, affixed to a substrate and having one or more softer, intermediate layer(s) therebetween. Still more particularly, the present invention relates to a polycrystalline diamond enhanced cutter insert including a substrate and a plurality of layers on the substrate, wherein the layers include an ultrahard layer supported on an additional layer, and wherein at least one of the layers is harder and/or more wear resistant than at least one of the layers above it.

BACKGROUND OF THE INVENTION

In a typical drilling operation, a drill bit is rotated while being advanced into a soil or rock formation. The formation is cut by cutting elements on the drill bit, and the cuttings are flushed from the borehole by the circulation of drilling fluid that is pumped down through the drill string and flows back toward the top of the borehole in the annulus between the drill string and the borehole wall. The drilling fluid is delivered to the drill bit through a passage in the drill stem and is ejected outwardly through nozzles in the cutting face of the drill bit. The ejected drilling fluid is directed outwardly through the nozzles at high speed to aid in cutting, flush the cuttings and cool the cutter elements.

The present invention is described in terms of cutter elements for roller cone drill bits. In a typical roller cone drill bit, the bit body supports three roller cones that are rotatably mounted on cantilevered shafts, as is well known in the art. Each roller cone in turn supports a plurality of cutter elements, which cut and/or crush the wall or floor of the borehole and thus advance the bit.

Conventional cutting inserts typically have a body consisting of a cylindrical grip portion from which extends a convex protrusion. In order to improve their operational life, these inserts are preferably coated with an ultrahard material such as polycrystalline diamond. The cutting layer typically comprises a superhard substance, such as a layer of polycrystalline diamond, thermally stable diamond or any other ultrahard material. The substrate, which supports the coated cutting layer, is normally formed of a hard material such as tungsten carbide (WC). The substrate typically has a body consisting of a cylindrical grip from which extends a convex protrusion. The grip is embedded in and affixed to the roller cone and the protrusion extends outwardly from the surface of the roller cone. The protrusion, for example, may be hemispherical, which is commonly referred to as a semi-round top (SRT), or may be conical, or chisel-shaped, or may form a ridge that is inclined relative to the plane of intersection between the grip and the protrusion. The latter embodiment, along with other non-axisymmetric shapes, is becoming more common, as the cutter elements are designed to provide optimal cutting for various formation types and drill bit designs.

The basic techniques for constructing polycrystalline diamond enhanced cutting elements are generally well known and will not be described in detail. They can be summarized as follows: a carbide substrate is formed having a desired surface configuration and then placed in a mold with a superhard material, such as diamond powder and/or its mixture with other materials which form transition layers, and subjected to high temperature and pressure, resulting in the formation of a diamond layer bonded to the substrate surface.

Although cutting elements having this configuration have significantly expanded the scope of formations for which drilling with diamond bits is economically viable, the interface between the substrate and the diamond layer and/or the transition layers continues to limit usage of these cutter elements, as it is prone to failure. Specifically, it is not uncommon for diamond coated inserts to fail during cutting. Failure typically takes one of three common forms, namely spalling/chipping, delamination and wear. External loads due to contact tend to cause failures such as fracture, spalling, and chipping of the diamond layer. Internal stresses, for example thermal residual stresses resulting from the manufacturing process, tend to cause delamination between the diamond layer and the substrate or the transition layer, either by cracks initiating along the interface and propagating outward, or by cracks initiating in the diamond layer surface and propagating catastrophically along the interface. Excessively high contact stresses and high temperatures, along with a very hostile downhole environment, also tend to cause severe wear to the diamond layer.

One explanation for failure resulting from internal stresses is that the interface between the diamond and the substrate or a transition layer is subject to high residual stresses resulting from the manufacturing processes of the cutting element. Specifically, because manufacturing occurs at elevated temperatures, the differing coefficients of thermal expansion of the diamond and substrate material transition layer result in thermally-induced stresses as the materials cool down from the manufacturing temperature. These residual stresses tend to be larger when the diamond/transition-layer/substrate interfaces have smaller radii of curvature. At the same time, as the radius of curvature of the interface increases, the application of cutting forces due to contact on the cutter element produces larger debonding and other detrimental stresses at the interface, which can result in delamination. In addition, finite element analysis (FEA) has demonstrated that during cutting, high stresses are localized in both the outer diamond layer and at the diamond/transition-layers/tungsten carbide interfaces. Finally, localized loading on the surface of the inserts causes rings or zones of tensile stress, which the PCD layer is not capable of handling.

In addition, the cutting elements are subjected to extremes of temperature and heavy loads when the drill bit is in use. It has been found that during drilling, shock waves may rebound from the internal interface between the two layers and interact destructively.

The primary approach used to address the delamination problem in convex cutter elements is the addition of transition layers made of materials with thermal and elastic properties located between the ultrahard material layer and the substrate, applied over the entire substrate protrusion surface. These transition layers have the effect of reducing the residual stresses at the interface and thus improving the resistance of the inserts to delamination. An example of this solution is described in detail in U.S. Pat. No, 4,694,918 to Hall, which is incorporated herein in its entirety.

Transition layers have significantly reduced the magnitude of detrimental residual stresses and correspondingly increased durability of inserts in application. Nevertheless, basic failure modes still remain. These failure modes involve complex combinations of three mechanisms. These mechanisms are wear of the PCD, surface initiated fatigue crack growth, and impact-initiated failure.

The wear mechanism occurs due to the relative sliding of the PCD relative to the earth formation, and its prominence as a failure mode is related to the abrasiveness of the formation, as well as other factors such as formation hardness or strength, magnitude of contact stress, and the amount of relative sliding involved during contact with the formation. The fatigue mechanism involves the progressive propagation of a surface crack, initiated on the PCD layer, into the material below the PCD layer until the crack length is sufficient for spalling or chipping. Lastly, the impact mechanism involves the sudden initiation and propagation of a surface crack or internal flaw initiated in the PCD layer or at the interface, into the material below the PCD layer until the crack length is sufficient for spalling, chipping, or catastrophic failure of the enhanced insert.

All of these phenomena are deleterious to the life of the cutting element during drilling operations. More specifically, the residual stresses, when augmented by the repetitive stresses attributable to the cyclical loading of the cutting element by contact with the formation, may cause spalling, fracture and even delamination of the diamond layer from the transition layer or the substrate. In addition to the foregoing, state of the art cutting elements often lack sufficient diamond volume to cut highly abrasive formations, as the thickness of the diamond layer tends to be limited by the resulting high residual stresses and the difficulty-of bonding a relatively thick diamond layer to a curved substrate surface even with the conventional layout of the transition layers. For example, even within the diamond layer, residual stresses arise as a result of temperature changes. Because these stresses typically increase as the thickness of the layer increases, this factor tends to be viewed as limiting on thickness.

Hence, it is desired to provide a cutting element that provides increased wear resistance and life expectancy without increasing the risk of spalling or delamination.

SUMMARY OF THE INVENTION

The present invention provides a cutting element with increased wear resistance and life expectancy and decreased risk of spalling and delamination. The present cutter element includes at least one transition layer that has mechanical properties that do not lie on a gradient between the mechanical properties of the outermost layer and those of the substrate. The outermost layer or the surface layer may not be the hardest layer in terms of mechanical properties. The present cutter element compensates for the resulting residual stresses that might otherwise occur at the non-intermediate layer by providing an interface geometry that balances the reduction in bending stress that results from an decreased radius of curvature with the increase in interface delamination stresses resulting from a decreased radius of curvature.

The non-intermediate layer of the present invention can be either a discrete layer or can comprise a gradient or portion of a gradient within a single layer, so long as direction of the gradient is reversed with respect to adjacent layers. In each instance, one objective of the present invention is to provide an interruption or reversal of the gradient in at least one of the following properties: the moduli of elasticity, wear resistances, hardnesses, strengths, and coefficients of thermal expansion of the layers so that at least one of the softer and less wear resistant layers is supported by a harder and/or more wear resistant layer.

One preferred embodiment of the present invention comprises a substrate supporting at least three layers, with the layers comprising an ultrahard layer, a relatively soft layer of a material that is less wear resistant than the ultrahard, and a first additional layer, wherein at least one of the layers interrupts a gradient in a mechanical property of the layers. The mechanical properties include the moduli of elasticity, wear resistances, hardnesses, strengths, and coefficients of thermal expansion of the layers.

Another preferred embodiment comprises a substrate having a layer of ultrahard material affixed thereto and a relatively soft layer affixed to the ultrahard layer such that the ultrahard layer is between said substrate and said relatively soft layer.

Still another embodiment comprises a substrate and a layer of PCD, with a cushion layer supporting the PCD layer. The cushion layer has a gradient of hardness such that a first portion of cushion layer next to the substrate is harder than a second portion of said cushion layer that is next to the PCD layer.

Still another embodiment of the invention comprises a method for constructing a cutter element, by providing a substrate having a grip portion and an extending portion and providing a plurality of layers on the extending portion such that at least one of the layers is harder than at least another one of the layers.

BRIEF DESCRIPTION OF THE DRAWINGS

For a detailed description of a preferred embodiment of the invention, reference will now be made to the accompanying Figures wherein.

DETAILED DESCRIPTION OF THE PREFERRED EMBODIMENTS

As used in this specification, the term polycrystalline diamond and its abbreviation "PCD" refer to the material produced by subjecting individual diamond crystals to sufficiently high pressure and high temperature that intercrystalline bonding occurs between adjacent diamond crystals. An exemplary minimum temperature is about 1300° C. and an exemplary minimum pressure is about 35 kilobars. The minimum sufficient temperature and pressure in a given embodiment may depend on other parameters such as the presence of a catalytic material, such as cobalt, with the diamond crystals. Generally such a catalyst/binder material is used to assure intercrystalline bonding at a selected time, temperature and pressure of processing. As used herein, PCD refers to the polycrystalline diamond including cobalt. Sometimes PCD is referred to in the art as "sintered diamond."

Also as used herein, the terms "beneath" and "above" are used to refer to the relative positions of layers on the substrate. The terms refer to the relative positions as shown in the Figures, wherein the inserts are drawn with their grip portions downward, so that "beneath" refers to positions closer to the substrate and "above" refers to positions that are farther from the substrate.

Figure 1:
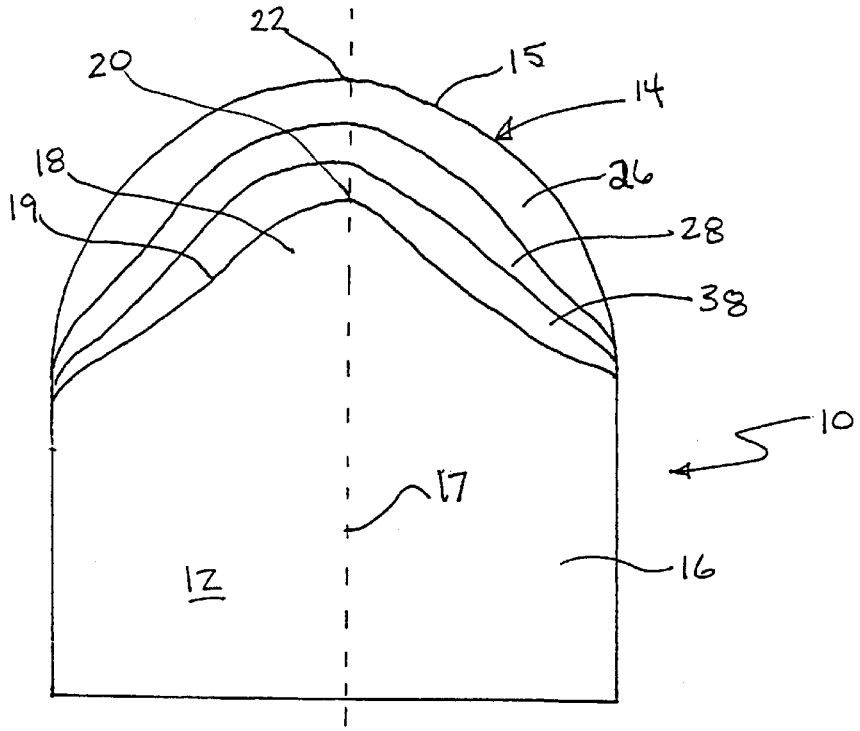
FIG. 1 is a cross sectional view of a cutting element constructed in accordance with a first embodiment of the invention.

Referring initially to FIG. 1, a cross sectional view of a cutting element 10 constructed in accordance with a first embodiment of the invention comprises a substrate 12, and a cutting layer 14. Substrate 12 comprises a body having a grip portion 16 and an extension portion 18. Grip portion 16 is typically cylindrical, although not necessarily circular in cross-section, and defines a longitudinal insert axis 17. Extension portion 18 includes an interface surface 19, which has an apex 20. According to one preferred embodiment, substrate 12 comprises tungsten carbide.

Cutting layer 14 is affixed to interface surface 19 and has an outer, cutting surface 15, which has an apex 22. Cutting layer 14 comprises at least two layers having differing physical properties. As discussed above, it is known to provide an outermost layer comprising polycrystalline diamond (PCD) and cobalt and one or more transition layers comprising diamond crystals, cobalt and tungsten carbide, so long as the proportion of diamond crystals in the material decreases inwardly towards the substrate and the transition layer(s) provides a gradient, or transition, between the mechanical properties of the substrate and the mechanical properties of the outermost layer. It will be understood that, while apices 20 and 22 are shown coincident with insert axis 17, the present invention can practiced on inserts for which this is not the case.

It has been discovered, however, that significant advantage can be realized from the placement of a harder layer behind or beneath at least one of the softer and/or less brittle layers. Reference to this layer herein as the "non-intermediate layer" refers to the fact that this layer interrupts the gradient in either the modulus of elasticity, wear resistance, coefficient of thermal expansion, hardness, strength, or any combination of these properties, that would otherwise be formed by the other layers on the cutter element and the substrate body itself. It will be understood that this layer is nevertheless positioned between two other layers or between one layer and the substrate.

By way of example, FIG. 1 shows an outermost PCD layer 26, beneath which is a transition layer 28. In one embodiment, transition layer 28 comprises a mixture of diamond crystals, cobalt and precemented tungsten carbide particles. For example, transition layer 28 might comprise between about 20 and about 80 percent by volume diamond crystals, from about 20 to about 60 percent by volume tungsten carbide, and between 5 and 20 percent cobalt. Transition layer 28 may ranges in thickness from zero around its edges to about 100 microns or more at its thickest. One preferred technique for setting or capping the thickness of the transition layer is to define it relative to the insert diameter. For example, the thickness of thickest portion of the layer is preferably no more than 40%, and preferably less than 30%, of the insert diameter and still more preferably less 20% of the insert diameter. It will be understood that the thickness of transition layer 28 may vary across its area, and need not be axisymmetric.

Still referring to FIG. 1, in a preferred embodiment a third, non-intermediate layer 38 is included between transition layer 28 and substrate surface 19. In accordance with the present invention, third layer 38 is harder and more wear resistant, and has a higher modulus of elasticity or higher hardness than layer 28. For example, layer 38 can comprise the same PCD material as outermost layer 26. Alternatively, layer 38 can comprise between about 20 and about 80 percent by volume diamond crystals, from about 20 to about 60 percent by volume tungsten carbide, and between 5 and 20 percent cobalt. In a preferred embodiment, the thickness of layer 38 equal to about 2–30% of the substrate diameter at its thickest point. It will be understood that the thickness of transition layer 38 may vary across its area, and need not be axisymmetric.

When layer 38 comprises PCD, the insert exhibits less residual stress on the interfaces between layers 28 and 38 and also between layers 26 and 28 when a larger radius of curvature is designed over interface surface 19. The insert also exhibits less Hertz contact tensile stress. In addition, the second diamond layer serves as a back-up wear layer that can extend the life of the insert in the event of failure of the outermost layer. The softer layer 28 serves as a cushion to absorb impact energy and allows the total diamond thickness to be increased without the increase in residual stresses that occur when the thickness of a single diamond layer is increased.

In another alternative embodiment, layer 38 comprises a conventional transition layer and layer 28 comprises a material having a smaller modulus of elasticity and/or decreased wear resistance as compared to layer 38, such as a transition layer with a higher tungsten carbide and cobalt content. In this embodiment again layer 38 interrupts the gradient in the mechanical properties that is defined by outermost layer 26 and layer 28.

Figure 2:
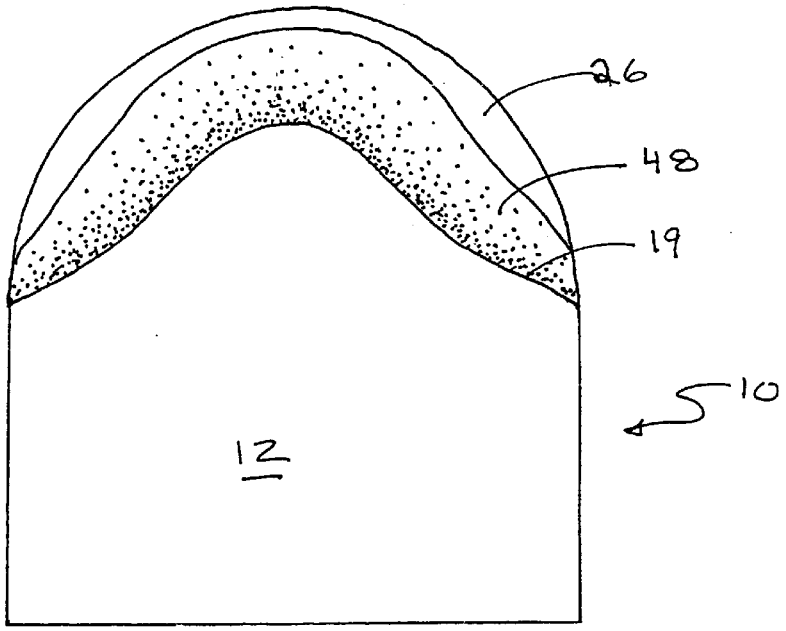
FIG. 2 is a cross sectional view of a cutting element constructed in accordance with a second embodiment of the invention.
Figure 2A:
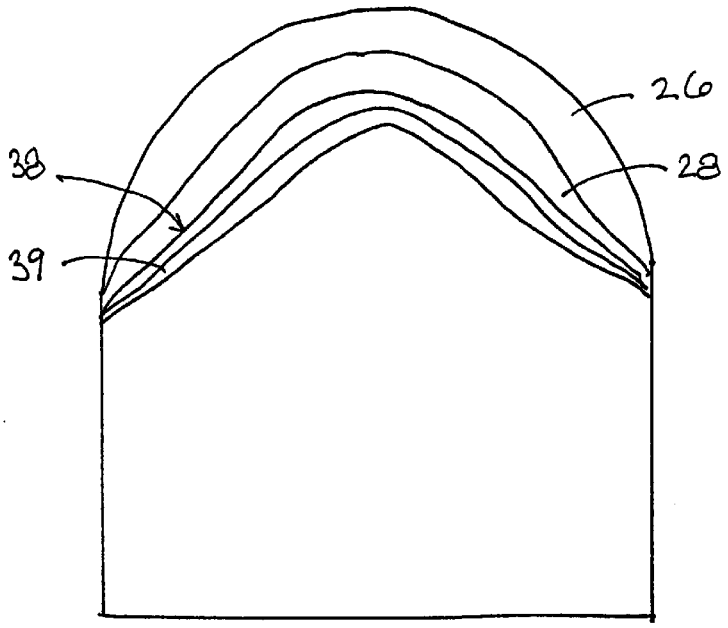
FIG. 2A is a cross sectional view of a cutting element constructed in accordance with an alternate embodiment of the invention.

Referring now to FIG. 2A, in still another alternative embodiment, outermost layer 26 comprises the mixture of tungsten carbide and PCD or another material that is softer than PCD, for example a diamond composite, In this embodiment, it is preferred that layer 28 comprise PCD and layer 38 comprise a second transition layer 39. In this embodiment, the outermost layer 26 can function to absorb impact energy, while the diamond layer 28 provides stiffness to reduce contact stress and also provides extended wear life after outermost layer is worn away.

An alternative construction to that shown in FIG. 1 is illustrated in FIG. 2, in which transition layers 28 and 38 are replaced by a single layer 48. Layer 48 comprises a composite of diamond crystals, cobalt and tungsten carbide containing a lesser proportion of diamond crystals near the outer PCD layer 26 and a greater proportion of diamond crystals near the substrate surface 19. This graded layer can be used in any of the various embodiments described above. While the currently preferred embodiment comprises two distinct layers 28, 38, any number of layers can be used, as long at least one layer or portion of a layer interrupts the gradient in mechanical properties between the substrate and at least one layer or portion of a layer above the layer in question.

Figure 3:
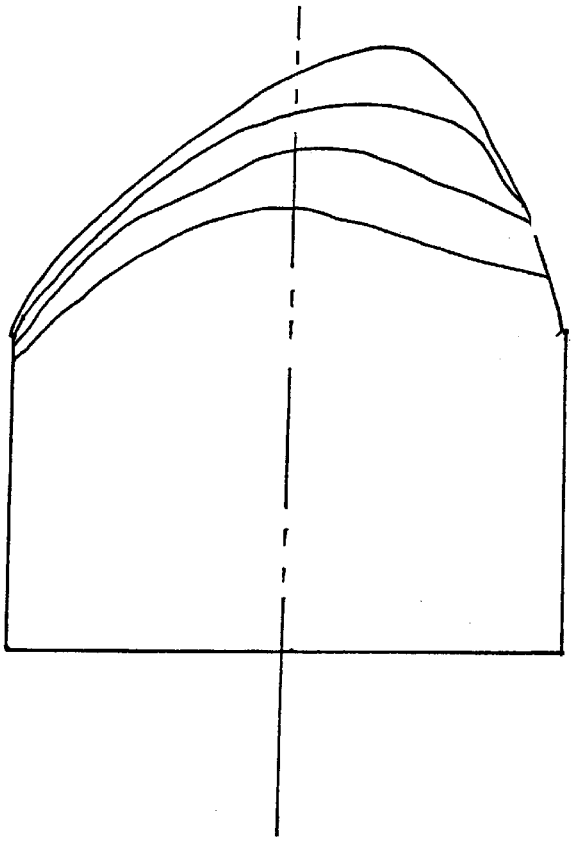
FIG. 3 is a cross-sectional view of a non-axisymmetric cutting element constructed in accordance with an embodiment of the invention.

The various embodiments of the present invention can be used in conjunction with various interface shapes and cutter element shapes. Hence, the cutter element shapes to which the principles of the present invention can be applied are not limited to the embodiments shown. For example, the basic shape of the cutter element need not be axisymmetric and can vary, including SRT, conical, chisel-shaped or relieved shapes, and have positive or negative tangents. An exemplary non-axixymmetric shape is shown in FIG. 3 In addition, the shape of the outer surface of the cutting layer can vary from those illustrated and the thickness of each layer can vary from point to point. In each instance, the present invention contemplates optimizing the shape of the interface between the cutting layer and the substrate so as to balance the residual stresses that result from manufacturing with the stress distribution from mechanical loading. This optimization allows substantial gains to be made in the localized enhancement of the cutting layer, thereby increasing cutter life.

While the cutter elements of the present invention have been described according to the preferred embodiments, it will be understood that departures can be made from some aspects of the foregoing description without departing from the spirit of the invention. For example, while the outer abrasive cutting surface of the cutting element of this invention is described in terms of a polycrystalline diamond layer, other materials, for example, cubic boron nitride, diamond composite, or a combination of superhard abrasive materials, may also be used for the cutting surface of the abrasive cutting element. Likewise, while the preferred substrate material comprises cemented or sintered carbide of one of the Group IVB, VB and VIB metals, which are generally pressed or sintered in the presence of a binder of cobalt, nickel, or iron or the alloys thereof, it will be understood that alternative suitable substrate materials can be used.

What is claimed is:

1. An insert for use in a roller-cone drill bit, comprising:

a substrate supporting a non-planar cutting layer, said cutting layer having a cutting surface comprising:

an ultrahard layer;

a relatively soft layer comprising a material that is less wear resistant than said ultrahard material; and a first additional layer;

wherein at least one of said layers interrupts a gradient in a mechanical property of the layers, the mechanical property being selected from: the moduli of elasticity, wear resistances, hardnesses, strengths, and coefficients of thermal expansion of the layers.

2. The insert according to claim 1 wherein said first additional layer comprises an ultrahard material, further comprising a second additional layer.

3. The insert according to claim 1 wherein said first additional layer comprises tungsten carbide, further comprising a second additional layer positioned between said substrate and said ultrahard layer.

4. The insert according to claim 1, further comprising a second additional layer that includes a gradient of ultrahard material such that a first portion of said second additional layer is harder than a second portion of said second additional layer, said first portion being between said second portion and said substrate.

5. The cutting element according to claim 1 wherein said cutting surface is axisymmetric.

6. The cutting element according to claim 1 wherein said cutting surface is hemispherical.

7. The cutting element according to claim 1 wherein said cutting surface is not axisymmetric.

8. The insert according to claim 1 wherein said layers define a plurality of interface surface and wherein at least one of said interface surfaces is not axisymmetric.

9. The cutting element according to claim 1 wherein said relatively soft layer is more wear resistant than said substrate.

10. The insert according to claim 9 wherein said first additional layer comprises an ultrahard material.

11. The insert according to claim 9 wherein said first additional layer comprises tungsten carbide.

12. The insert according to claim 9 wherein said cutting surface is axisymmetric.

13. The insert according to claim 9 wherein said cutting surface is hemispherical.

14. The insert according to claim 9 wherein said cutting surface is not axisymmetric.

15. The insert according to claim 9 wherein said layers define a plurality of interface surfaces and wherein at least one of said interface surfaces is not axisymmetric.

16. A cutting element for use in a roller-cone drill bit, comprising:

a substrate with an apex;

a layer of ultrahard material having a non-planar cutting surface; and a cushion layer affixed to said substrate and supporting said ultrahard material layer and having a gradient of hardness such that a first portion of said cushion layer is harder then a second portion of said cushion layer, said first portion being between said second portion and said substrate.

17. The insert according to claim 16, further including an additional layer.

18. The insert according to claim 16 wherein said ultrahard material comprises polycrystalline diamond.

19. The cutting element according to claim 16 wherein said cutting surface is axisynunetric.

20. The cutting element according to claim 16 wherein said cutting surface is hemispherical.

21. The cutting element according to claim 16 wherein said cutting surface is not axisymmetric.

22. The cutting element according to claim 16 wherein said substrate and said cushion layer define an interface surface that is not axisymmetric.

23. A method for constructing a cutter element for a roller-cone drill bit, comprising:

a) providing a substrate having a grip portion and an extending portion;

b) providing a plurality of layers on the extending portion such that at least one of the layers is harder than at least another one of the layers, said layers defining a cutting layer having a non-planar cutting surface; and c) providing a cushion layer having a gradient of hardness such that a first portion of said cushion layer is harder than a second portion of said cushion layer, said first portion being between said second portion and said substrate.

24. The method according to claim 23 wherein step (b) includes providing a layer of PCD.

25. A method for constructing a cutter element for a roller cone drill bit, comprising:

a) providing a substrate having a grip portion and an extending portion; and b) providing a plurality of layers on the extending portion such that at least one of the layers is harder than at least another one of the layers, said layers defining a cutting layer having a non-planar cutting surface;

wherein step (b) comprises providing a layer comprising a composite of ultrahard material, cobalt and tungsten carbide containing a greater proportion of tungsten carbide particles away from said substrate and a greater proportion of ultrahard material near said substrate.

26. A cutting element for use in a roller-cone drill bit, comprising:

a substrate;

a layer of ultrahard material affixed to said substrate; and a relatively soft layer affixed to said ultrahard layer such that said ultrahard layer is between said substrate and said relatively soft layer, wherein said layers define a plurality of interface surfaces and wherein at least one of said interface surfaces is not axisymmetric.

27. The cutting element according to claim 26 wherein said ultrahard material comprises polycrystalline diamond.

28. A cutting element for a roller cone drill bit, comprising:

a substrate comprising a grip portion and an interface surface where said interface surface has an apex; and a cutting layer affixed to said interface surface and having a non-planar cutting surface, wherein said cutting layer comprises:

an outermost layer;

a transition layer contracting said outermost layer and said interface surface wherein said transition layer interrupts a gradient in a mechanical property of said layers and said surface, the mechanical property being selected from: the moduli of elasticity, wear resistances, hardnesses, strengths, and coefficients of thermal expansion of said layers and said surface.

29. The cutting element of claim 28, further comprising a third layer that is located between said transition layer and said interface surface; said third layer having a higher hardness than said transition layer and interrupting a gradient in a mechanical property of said layers and said surface, the mechanical property being selected from: the moduli of elasticity, wear resistances, hardnesses, strengths, and coefficients of thermal expansion of said layers and said surface.

30. The cutting element of claim 28, further comprising a third layer that is located between said transition layer and said interface surface; said third layer having a lower hardness than said transition layer and interrupting a gradient in a mechanical property of said layers and said surface, the mechanical property being selected from: the moduli of elasticity, wear resistances, hardnesses, strengths, and coefficients of thermal expansion of said layers and said surface.

31. A cutting element for a roller cone drill bit, comprising:

a substrate comprising a grip portion and an interface surface where said interface surface has an apex; and a cutting layer affixed to said interface surface and having a non-planar cutting surface, wherein said cutting layer comprises:

an outermost layer;

a transition layer contacting said outermost layer and said interface surface wherein said transition layer comprises a gradient of ultrahard material wherein the greater proportion of ultrahard material is proximate to said substrate.

* * * * *